United States Patent [19]

McCord

[11] 4,339,283

[45] Jul. 13, 1982

[54] VAPOR GENERATING AND RECOVERING APPARATUS

[76] Inventor: James W. McCord, 9101 Nottingham Pkwy., Louisville, Ky. 40222

[21] Appl. No.: 122,007

[22] Filed: Feb. 19, 1980

[51] Int. Cl.[3] ..... B08B 7/04

[52] U.S. Cl. ..... 134/12; 134/31

[58] Field of Search ..... 202/170, 236, 235, 180, 202/195; 203/24, 26, DIG. 4, 90; 134/19, 12, 31, 34

[56] References Cited

U.S. PATENT DOCUMENTS

| | | | |
|---|---|---|---|
| 3,494,794 | 2/1970 | Hittel | 134/19 |
| 3,593,729 | 7/1971 | Goldware | 202/170 |
| 4,003,798 | 1/1977 | McCord | 202/170 |
| 4,038,155 | 7/1977 | Reber | 202/170 |
| 4,077,467 | 3/1978 | Spigarelli | 202/170 |

FOREIGN PATENT DOCUMENTS

| | | | |
|---|---|---|---|
| 2600398 | 7/1977 | Fed. Rep. of Germany | 203/24 |

*Primary Examiner*—Hiram Bernstein

*Attorney, Agent, or Firm*—Charles G. Lamb

[57] ABSTRACT

A vapor generating and recovering apparatus for vaporizing a liquid and condensing a vapor, the apparatus including a container having a liquid therein with a heating and cooling system in heat transfer relation with the liquid and vapor in the container. The heating and cooling system includes means to vaporize the liquid and means to condense the vaporized liquid disposed within the container. The apparatus further includes means to remove liquid from the container and return same to the container in the form of a liquid spray at boiling or higher temperatures.

5 Claims, 4 Drawing Figures

VAPOR GENERATING AND RECOVERING APPARATUS

BACKGROUND OF THE INVENTION

This invention relates to a vapor generating and recovering apparatus for vaporizing a liquid and condensing a vapor and more particularly relates to an improved apparatus having means for removing liquid from the container and returning same to the container in the form of a spray at boiling or higher temperatures.

In the present state of the art, vapor generating and recovering devices for vaporizing and condensing a liquid are utilized in many different areas. For example, in the cleaning of objects such as metallic tools, plastic parts, and the like, hot or boiling solvents have been utilized to remove undesirable soluble and particulate matter from these tools, parts, and the like by immersing the soiled object into hot or boiling solvent. In bringing the solvent to a boiling temperature, a solvent vapor zone is created above the boiling solvent solution in the tank or chamber in which objects may be placed for cleaning. The vaporized solvent is then subjected to cooling or condensing means and is recovered.

In some operations, spraying of hard to clean objects, sensitive devices, and entrapment items with a hot volatile solvent is a preferred method of cleaning. This spraying of a volatile solvent for cleaning objects is usually done in lieu of immersion in a boiling or cold liquid solvent environment, or cold spray.

SUMMARY OF THE INVENTION

It has now been found that a vapor generating and recovering apparatus for vaporizing a liquid and then condensing the vaporized liquid in the cleaning of objects, the cleaning can be accomplished by spraying the liquid into the vapor zone of the apparatus at a temperature equal to or greater than the boiling temperature of the liquid. It has been found that in cleaning certain objects, spraying a solvent onto the object to be cleaned can be performed in a vapor zone of a vapor generating and recovering apparatus without breaking the vapor level. By spraying the cleaning solvent at or above the boiling temperature of the solvent, the vapor level or zone will not collapse and therefore enables the cleaning of certain objects by use of a spray at boiling temperatures or above in a vapor zone without the vapor escaping from the container. The advantages of spraying, boiling, or super-heated liquid include improved solvency, impingement cleaning, rapid evaporation from the part, immediate heat transfer to the part, carrier, or conveyor, and the absense of heat transfer to the vapor which reduces distillation and collapses the vapor. The ultimate result is reduction of organic chemical emmissions and money savings.

In the present invention, the heating and cooling system may include a refrigerant compressor, a main refrigerant condenser, expansion means, and a refrigerant evaporator wherein the condenser and evaporator are disposed within a container which includes the liquid therein for removing heat from the system. However, it is also realized that the heating and cooling portions of the system may be independent of each other and the energy requirements therefore supplied from different sources.

In the spraying of the solvent the solvent is generally pumped from the liquid zone of the apparatus and sprayed into the vapor zone. As the liquid is generally at boiling temperature during operation, additional heat is not necessary to maintain the solvent at boiling temperature. However, under some conditions additional heat is necessary to maintain the solvent at boiling temperature and under other conditions where spraying is desired at temperatures exceeding boiling, additional heat means is also required with higher discharge pressures.

More particularly, in a vapor generating and recovering apparatus for vaporizing a liquid and condensing a vapor, including a housing having at least one compartment therein, the compartment having a liquid therein, the improvement comprising: heating means in heat transfer relation with the liquid in a liquid zone in the compartment, cooling means in heat absorbing relation with the vapor in a vapor zone in the compartment; means to transfer liquid from the liquid zone to the vapor zone; and, means to spray liquid from the means to transfer liquid at a temperature at least equal to the boiling point of the liquid.

In preferred utilization of the vapor generating and recovery devices of the present invention, specifically in relation to a vapor cleaning device, a more fully described apparatus is hereinafter discussed.

BRIEF DESCRIPTION OF THE DRAWINGS

Referring to the drawings.

DESCRIPTION OF THE PREFERRED EMBODIMENTS

Figure 1:
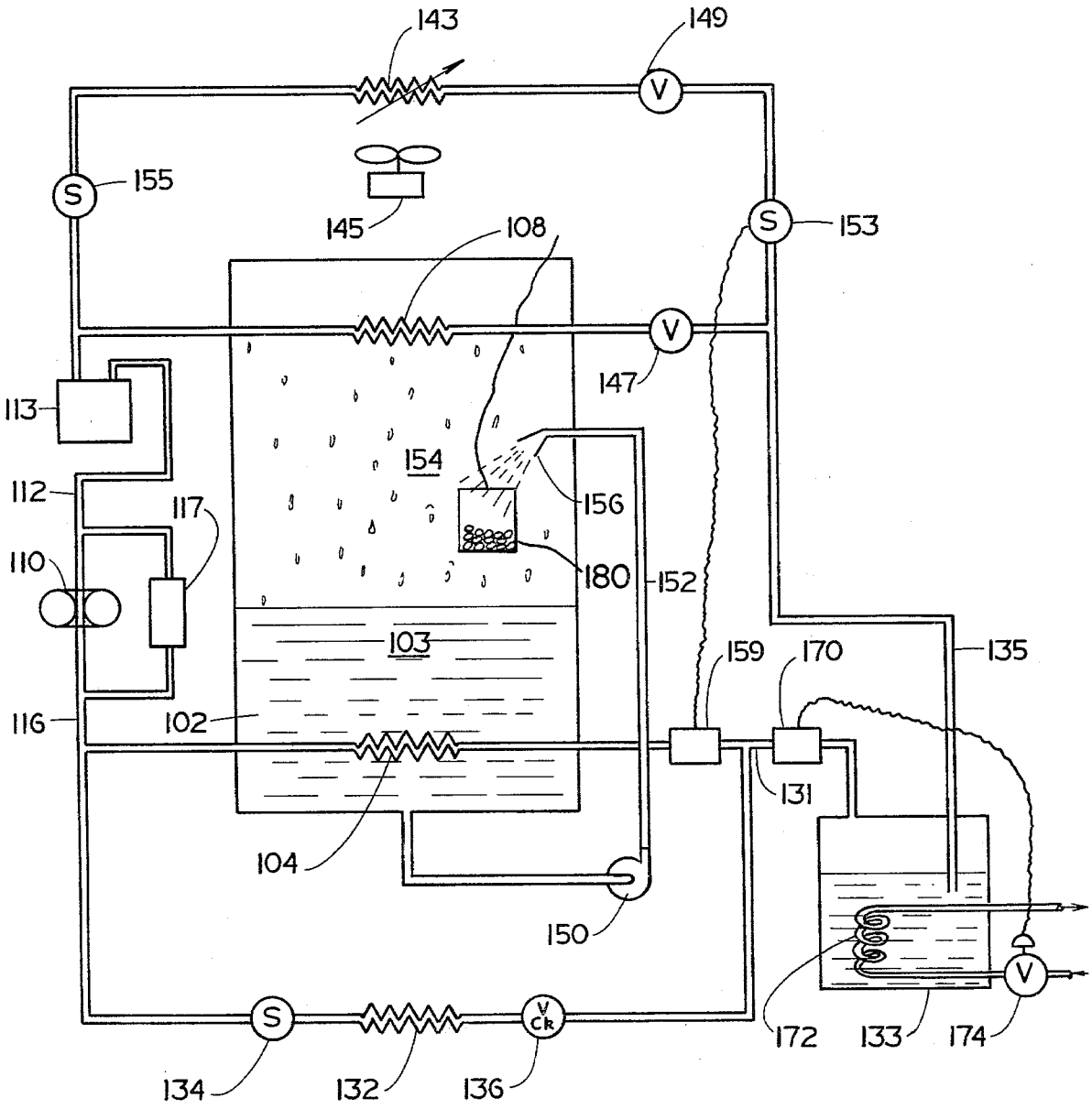
FIG. 1 is a schematic diagram of a preferred vapor generating and recovering apparatus of the present invention.

In FIG. 1, a container 102 for vaporizing a liquid 103 and then condensing the vaporized liquid is provided. Disposed within the liquid and near the bottom of the container 102 is a heating coil 104 which provides heat to vaporize the liquid 103. Heating coil 104 is a condensing coil in a heating and cooling system to be discussed hereinafter.

Disposed within the vapor zone of the container 102 is a cooling coil 108, cooling coil 108 being generally an evaporating coil in a heating and cooling system which will be discussed hereinafter. Cooling coil 108 is provided to maintain a preselected temperature in the container below the vaporizing temperature of the liquid.

In the heating and cooling system of FIG. 1, shown schematically, a compressor 110, of the type used in refrigerating systems, compresses a suitable refrigerant which flows to the compressor 110 in a refrigerant section conduit 112. Provided within conduit 112 is a suction accumulator 113 which conditions the refrigerant to compressor 110. Suction accumulator 113 is utilized to provide gaseous refrigerant to compressor 110.

Compressor 110 compresses the suitable gaseous refrigerant to a preselected pressure and the pressurized hot refrigerant gas flows from the compressor 110 through conduit 116 to the heating coil 104, discussed previously, wherein the refrigerant is condensed therein and upon condensing vaporizes the liquid 103 which is disposed within container 102.

Dual pressure control switch 117 is provided and is operable in response to change in the pressure on each side of the compressor 110 and is a feature utilized to shut down the heating and cooling system when the system is being pumped down or exceeds preselected upper pressure limits.

In some devices, it is desired to utilize a plurality of heat emitting chambers and in this instance a plurality of condensing units 132 are utilized and disposed within vaporizing chamber or sub-chambers (not shown) generally similar to containor 102. As shown, condensers 104 and 132 are in parallel and a solenoid valve 134 is provided to shut off refrigerant flow to the condenser 132 when the chamber(s) in which the condenser(s) 132 is utilized is not in use. Furthermore, a check valve 136 is provided to prevent back up of refrigerant into condenser 132 when not in use.

The condensed or pressurized liquid refrigerant then flows through conduit 131 to conventional liquid refrigerant receiver 133. In a preferred embodiment, receiver 133 operates as a complementary condenser to balance energy into the system, In this mode, receiver 133 includes a heat exchanger 172 operable in response to the actuation of a pressure sensing device 170 in line 131. The heat transfer fluid may be water and is controlled by actuating of control valve 174 in response to the preselected pressure sensed by sensing device 170. From the liquid refrigerant receiver 133, the refrigerant flows by way of conduit 135 to a plurality of thermo-expansion valves and direct expansion evaporating coils in parallel, each thermo-expansion valve being in series with an evaporating coil. Two evaporating coils 108 and 143 with thermoexpansion valves 147 and 149, respectively, are shown in the Figures. Evaporator coil 143 is the supplementary evaporator and is disposed to provide heat to the system transferring said heat from an external source, such as a warm air blower 145, to maintain the heat transfer across exchanger 108 at a preselected rate. Heat exchanger 143, being outside container 102, is operable, for example, in response to a pressure control device 159 in the high pressure refrigerant line 131 and, in turn, actuates and controls solenoid valve 153. Control valve 153 is also in electrical communication with warm air blower 145 actuating the blower 145 in response to flow through valve 153. However, it is relaized that other forms of control and sensing devices may be utilized for sensing and controlling the flow of refrigerant through the supplemental evaporator 143. Also, other means of adding heat to the refrigerant, such as water, heat transfer fluid, and the like may be used instead of warm air.

In the Figures, hot boiling solvent 103 is pumped from the bottom of container 102 by pump 150 through conduit 152 to the vapor zone 154. Solvent 103 is then sprayed by a known spray device 156 into the vapor zone 154.

In FIG. 1, a basket of parts 180 to be cleaned is also shown.

Figure 2:
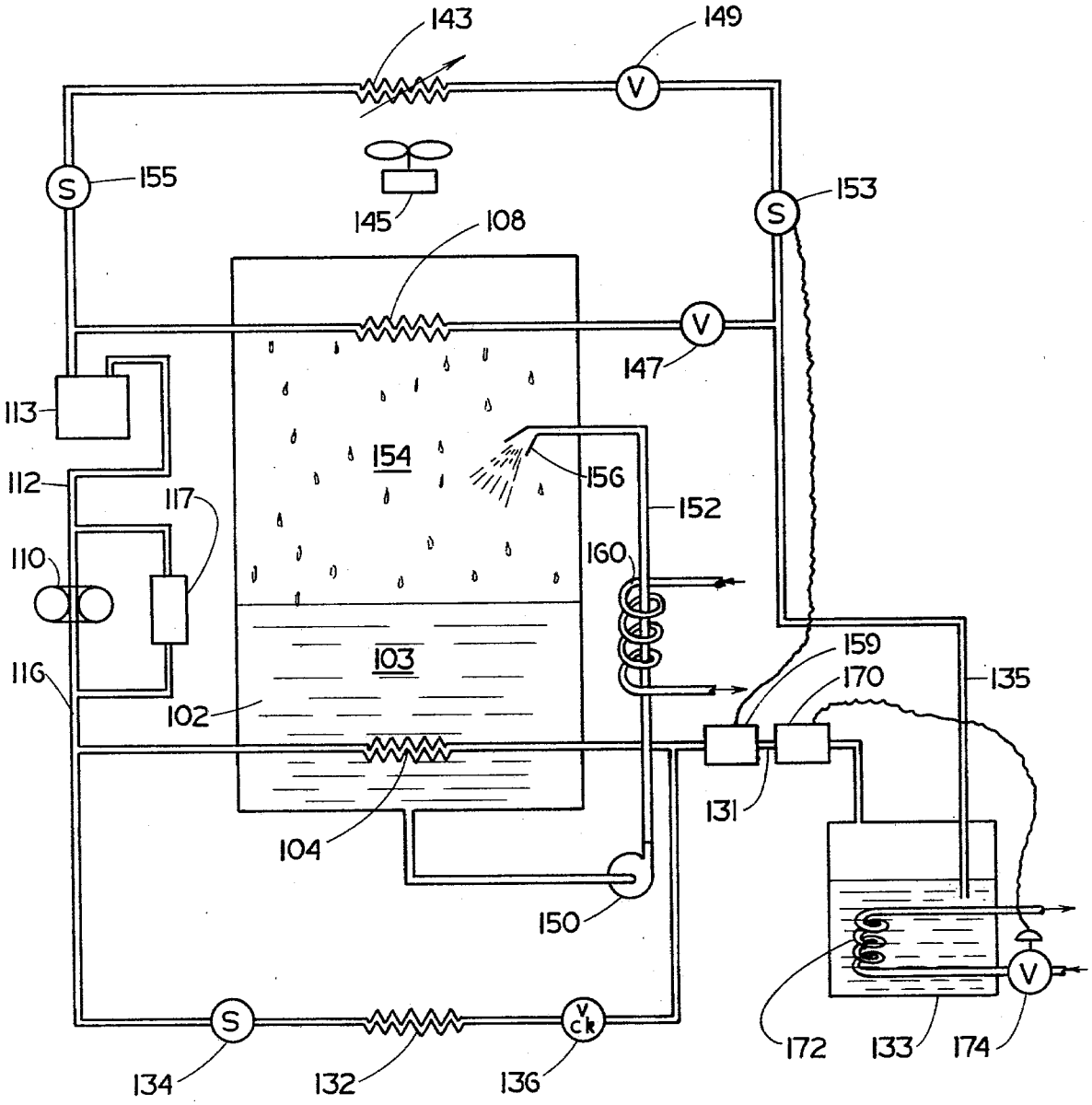
FIG. 2 is a schematic diagram showing one modification of the apparatus of FIG. 1.
Figure 3:
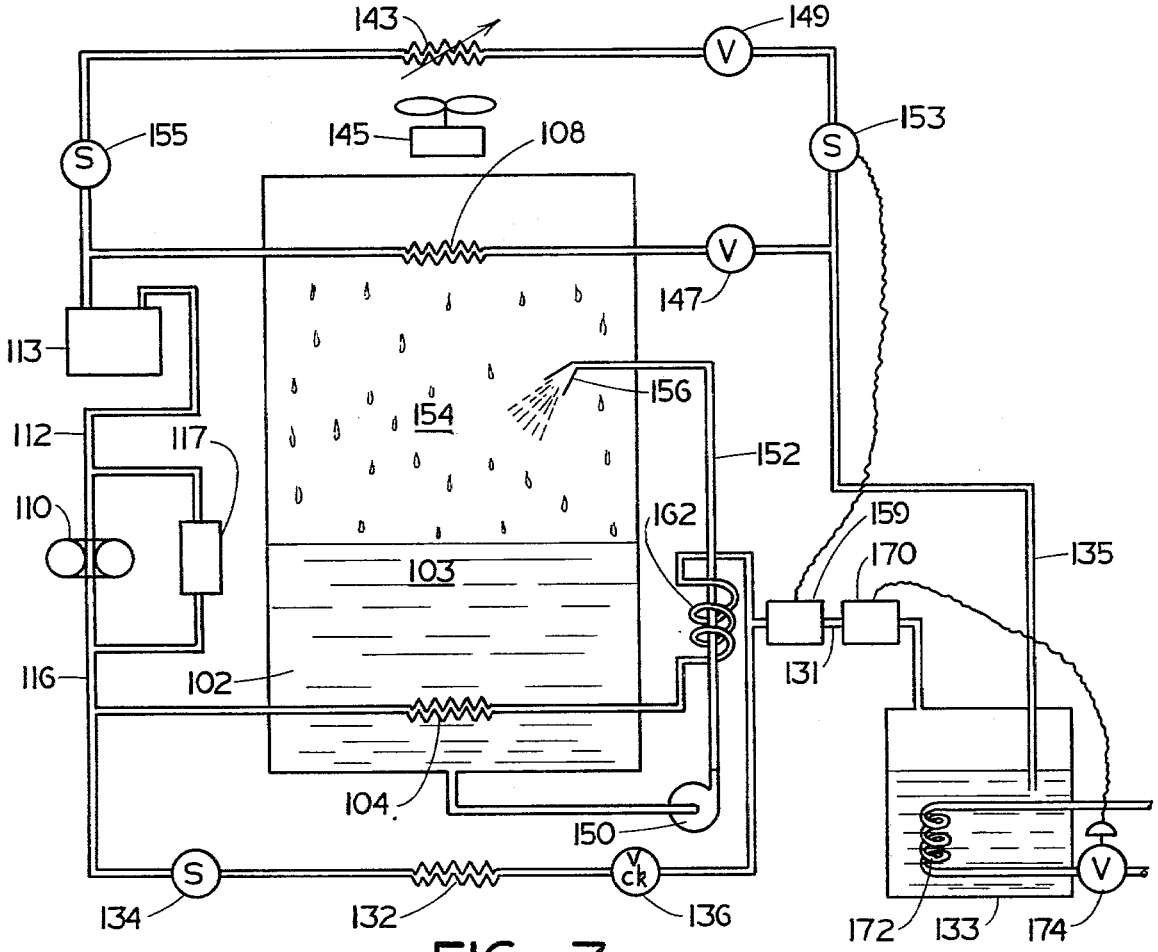
FIG. 3 is a schematic diagram of another preferred vapor generating and recovering apparatus of the present invention; and, FIG. 4 is a schematic diagram of even another vapor generating and recovering apparatus of the present invention.

In FIGS. 2 and 3 means are shown for heating the liquid solvent to temperatures equal to or greater than the temperature of the vapor zone 154.

In FIG. 2 additional heat from a separate heat supply source (not shown) is provided through coil 160 to the solvent in conduit 152.

In FIG. 3 the heating and cooling system hereinbefore described is utilized to provide heat to the solvent. In FIG. 3, heat is supplied through heat exchanger 162 which is a heat exchanger in series with and downstream from heat exchanger 104. It is realized that even though the heat exchanger 104 is in series with 162, heat exchangers 104 and 162 may be in parallel.

Figure 4:
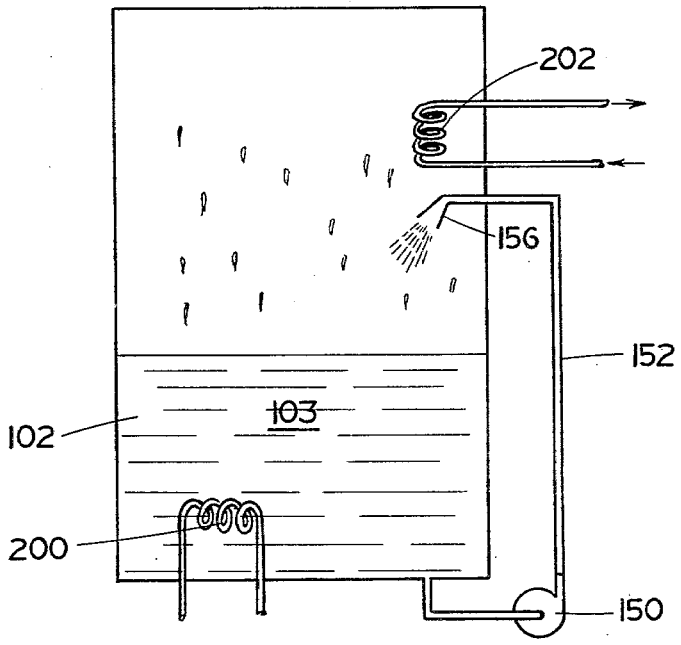

In FIG. 4, any conventional or well known means is utilized as the heating and cooling means. In the vaporization zone heat exchanger 200 is utilized to vaporize the solvent and in the condensing zone heat exchanger 202 is utilized to condense the vapor.

It will be realized that various changes may be made to the specific embodiments shown and described without departing from the principles and spirit of the present invention.

What is claimed is:

1. In a vapor generating and recovering apparatus for vaporizing a liquid and condensing vapor, including a housing having at least one cleaning compartment therein, said compartment having a liquid and a vapor therein, the improvement comprising:

first heating means in heat transfer relation with said liquid in a liquid zone in said compartment; first cooling means in heat absorbing relation with the vapor in a vapor zone in the compartment; means to transfer liquid from said liquid zone to said vapor zone; and, means to spray liquid from the means to transfer liquid at a temperature at least equal to the boiling point of the liquid whereby upon spraying of an object to be cleaned the vapor zone is prevented from collapsing.

2. In the vapor generating and recovering apparatus of claim 1, said means to transfer liquid including second heat means to add heat to said liquid.

3. In the vapor generating and recovering apparatus of claim 2, said second heat means being from the same heat source as said first heat means.

4. In the vapor generating and recovering apparatus of claim 2, said second heat means being from a source separate from said first means.

5. In the vapor generating and recovering apparatus of claim 1, said first heat means and said first cooling means being in the same refrigeration system, said first heat means being the condenser and said first cooling means being the evaporator.

* * * * *